United States Patent [19]

Wolverton et al.

[11] 3,967,425

[45] July 6, 1976

[54] MODULAR STORAGE UNITS FOR BICYCLES OR THE LIKE

[76] Inventors: Richard A. Wolverton, 1620 N. Main St., Walnut Creek, Calif. 94596; Gordon H. Cooper, 785 T Oak Grove Road, Concord, Calif. 94518

[22] Filed: Aug. 26, 1974

[21] Appl. No.: 500,388

Related U.S. Application Data

[63] Continuation-in-part of Ser. No. 398,931, Sept. 20, 1973, abandoned, which is a continuation of Ser. No. 170,716, Aug. 11, 1971, abandoned.

[52] U.S. Cl. ..... 52/237; 52/79; 52/282

[51] Int. Cl.[2] ..... E04B 1/343

[58] Field of Search ..... 52/280, 282, 237, 79; 312/257 SK, 198

[56] References Cited

UNITED STATES PATENTS

| | | | |
|---|---|---|---|
| 1,378,417 | 5/1921 | Lee | 52/33 |
| 1,893,956 | 1/1933 | Michaels | 52/282 |
| 1,910,550 | 5/1933 | Kaser | 312/217 |
| 1,981,710 | 11/1934 | Rix | 220/84 |
| 2,578,644 | 12/1951 | Mautner | 220/84 |
| 2,642,197 | 6/1953 | Hainsworth | 52/33 |
| 2,643,171 | 6/1953 | Sterba | 312/198 |
| 2,892,581 | 6/1959 | Amatel | 229/90 |
| 3,042,470 | 7/1962 | Money | 312/198 |
| 3,150,903 | 9/1964 | Chapman | 220/84 |
| 3,257,154 | 6/1966 | Lewis | 52/79 |
| 3,316,041 | 4/1967 | Nelson | 220/84 |
| 3,380,768 | 4/1968 | Wolfensberger | 52/282 |
| 3,388,944 | 6/1968 | Crehore | 52/280 |
| 3,603,054 | 9/1971 | Didry | 52/280 |
| 3,682,523 | 8/1972 | Esposito | 312/198 |
| 3,710,736 | 1/1973 | Biondi | 52/40 |

FOREIGN PATENTS OR APPLICATIONS

| | | | |
|---|---|---|---|
| 561,119 | 10/1957 | Belgium | 312/257 SK |
| 730,879 | 8/1932 | France | 52/237 |
| 643,994 | 9/1928 | France | 52/66 |
| 342,834 | 10/1921 | Germany | 312/198 |
| 655 | 1/1896 | United Kingdom | 52/143 |
| 367,456 | 2/1932 | United Kingdom | 52/33 |

*Primary Examiner*—Ernest R. Purser
*Assistant Examiner*—Henry Raduazo
*Attorney, Agent, or Firm*—Phillips, Moore, Weissenberger Lempio & Strabala

[57] ABSTRACT

Modular units are disclosed for storing a single bicycle or the like in an individual locker. Each locker provides a volume which is trapezoidal-shaped in cross-section and includes a top wall connected to an end wall and a pair of side walls with the floor, ground, or other substrate forming the bottom wall. A door and door locking post are provided for each locker to enable it to be selectively opened or closed for a fee which may be collected by a coin operated mechanism in the door locking post. These units may be individually arrayed or arranged in linear or arcuate paths with variations in the individual units to interconnect such units in the desired array. According to this invention, a structure is provided for storage of a single bicycle in an individual locker with improved security and protection from the elements using parts which are interchangeable in different units of such structure.

12 Claims, 18 Drawing Figures

FIG _ 1
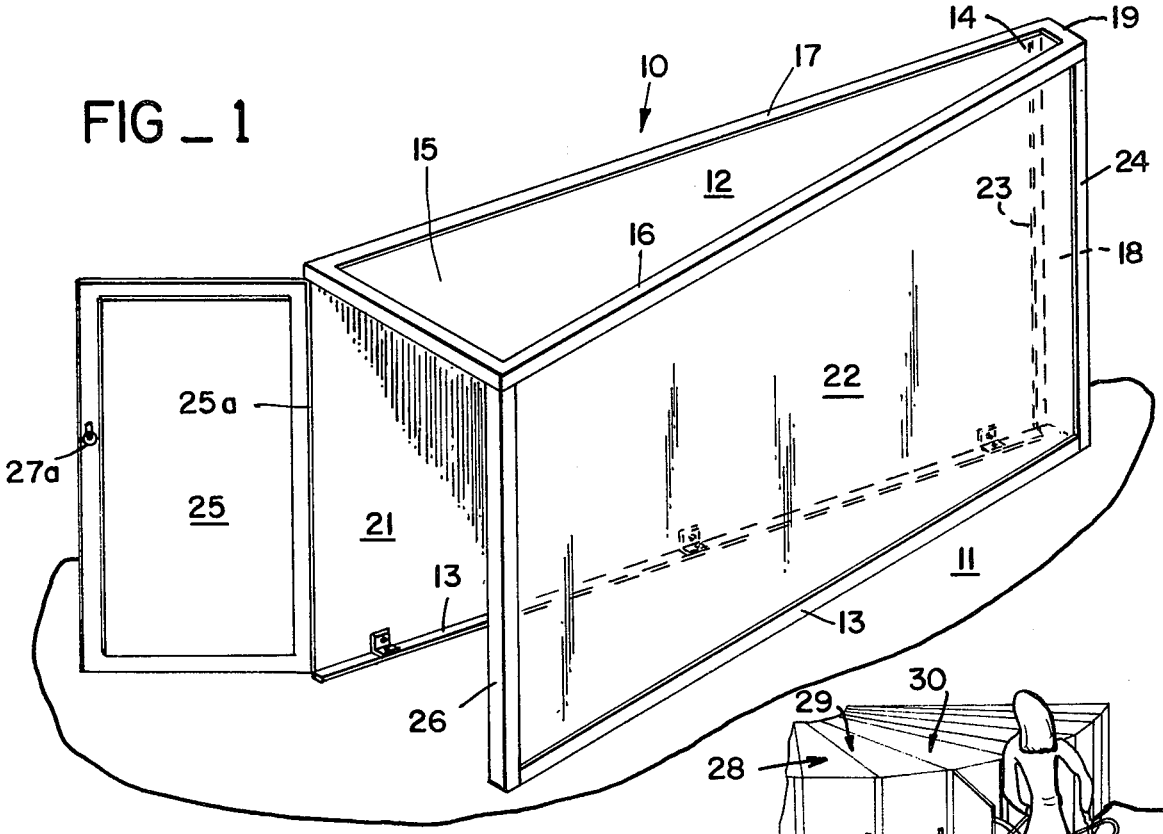
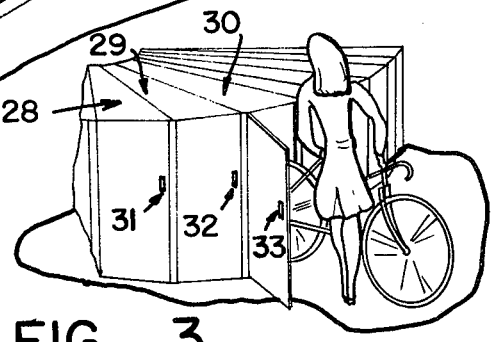
FIG _ 3
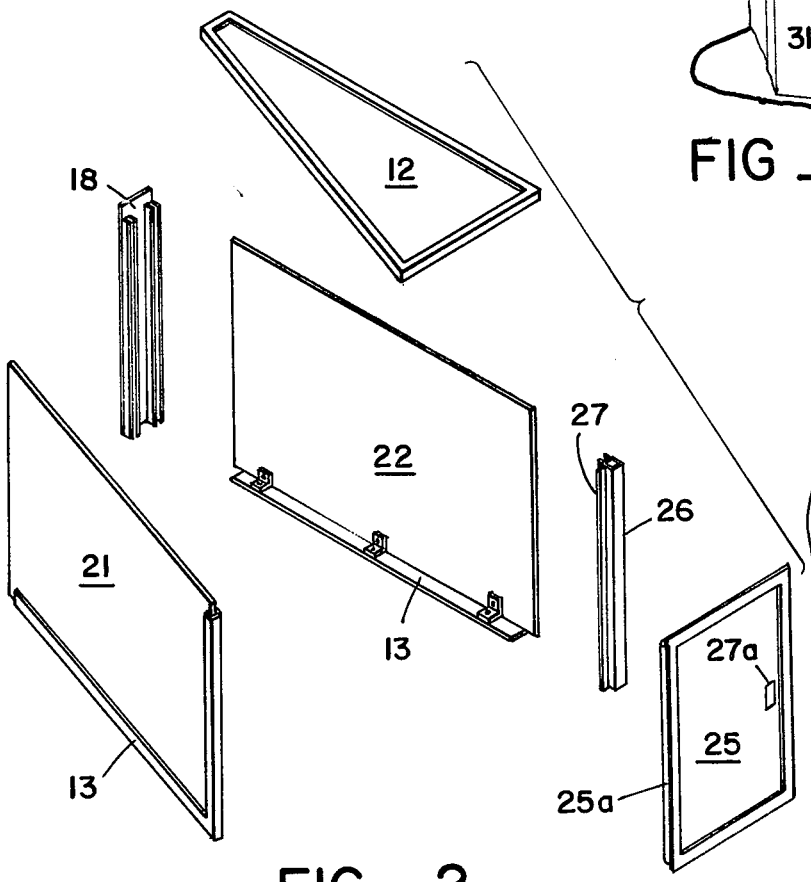
FIG _ 2
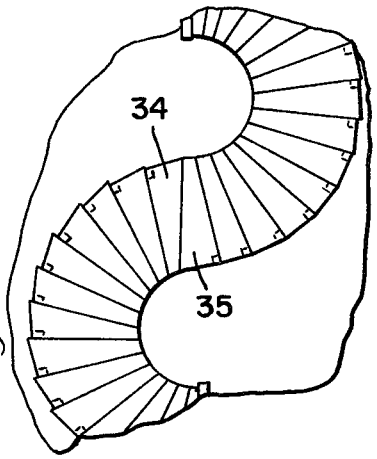
FIG _ 4

FIG _ 6
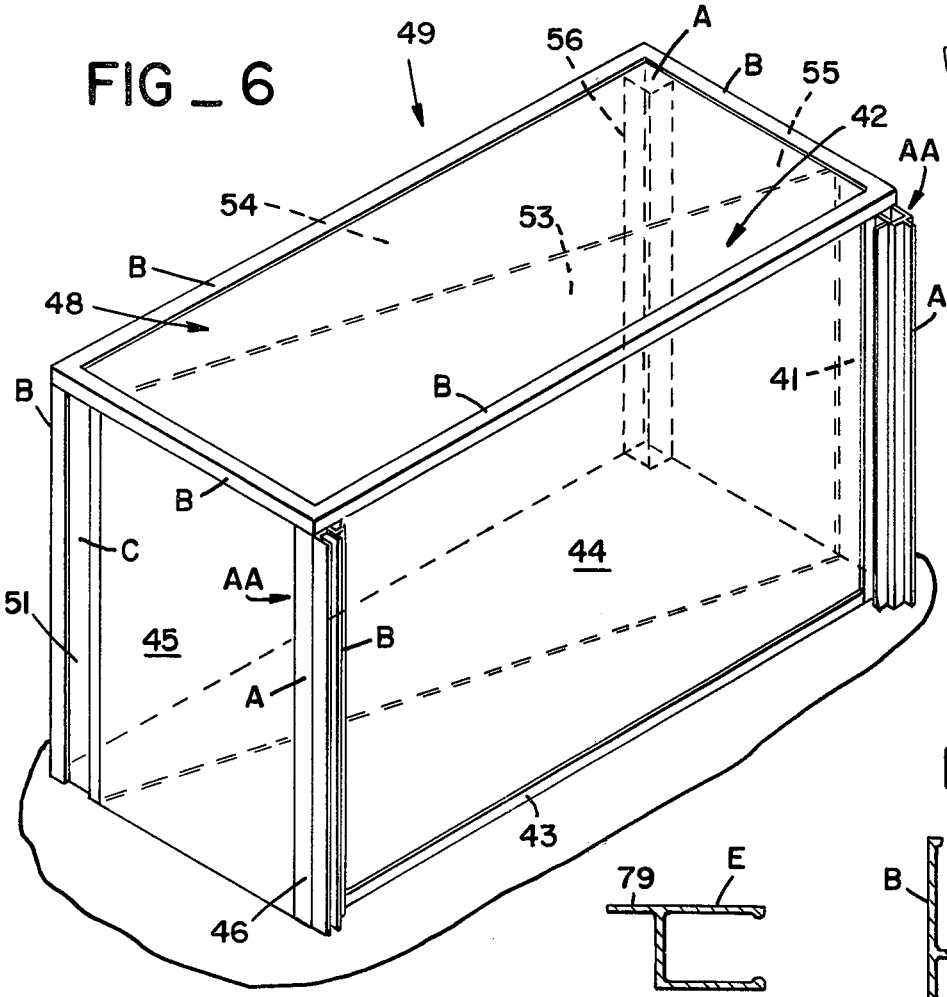
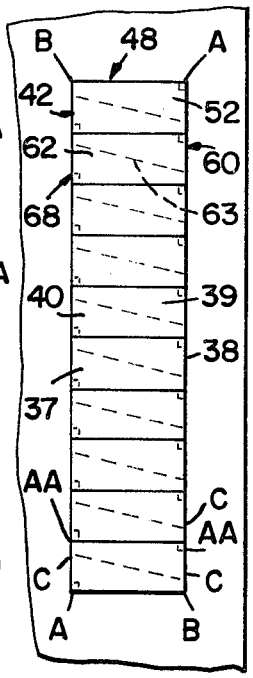
FIG _ 5
FIG _ 7E
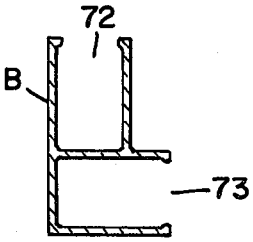
FIG _ 7B
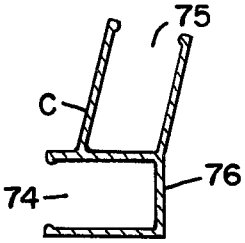
FIG _ 7C
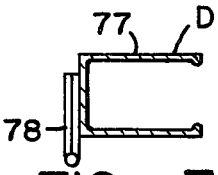
FIG _ 7D
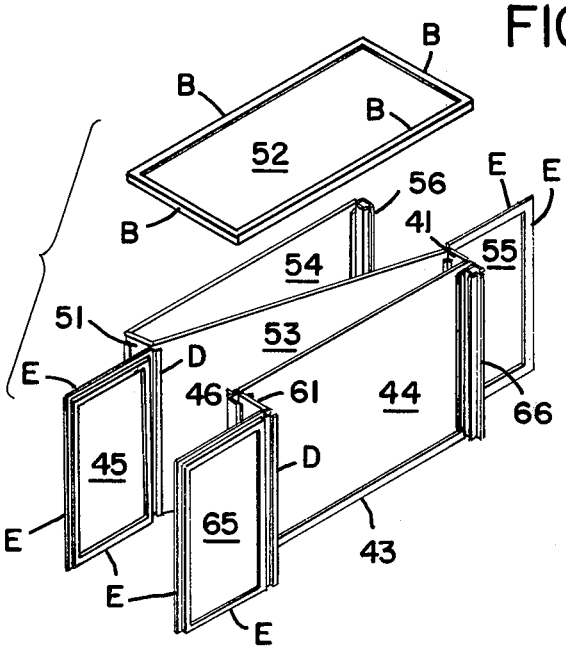
FIG _ 7
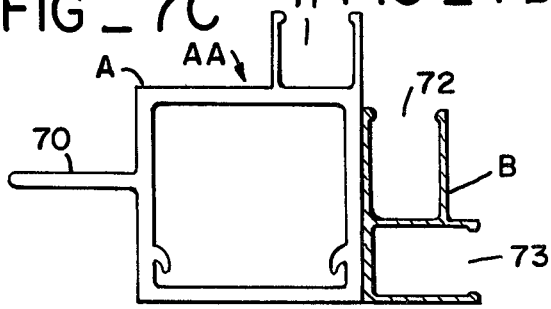
FIG _ 7A

MODULAR STORAGE UNITS FOR BICYCLES OR THE LIKE

CROSS-REFERENCE TO RELATED APPLICATIONS

This application is a continuation-in-part of our prior copending application, Ser. No. 398,931, filed Sept. 20, 1973 and now abandoned, which is in turn a continuation of our prior application Ser. No. 170,716, filed Aug. 11, 1971 and now abandoned, both for MODULAR STORAGE UNITS FOR BICYCLES OR THE LIKE.

BACKGROUND OF THE INVENTION

1. Field of the Invention

The invention relates to the storage of bicycles or the like; and more particularly, to modular units for storing, each for a fee, a number of bicycles in a small space using a reduced number of different parts to fabricate such units and providing improved security and protection from the elements.

2. Description of the Prior Art

There has been increased interest in recent years in the pollution of our environment. One of the biggest problems in this area is the pollution resulting from automobiles or the like. This is particularly true in places of great congestion, such as large metropolitan areas.

Accordingly, it has been suggested to use alternate means of transportation from outlying areas to the commuter's place of employment. For example, one such suggested means is a rapid transit system which propels commuters by electric means or the like from outlying sections to a centrally located metropolitan area. However, generally, the commuter must first get from his home to one of the stations along the rapid transit system and this distance may be quite far. Thus, the use of the automobile by the commuter is not entirely eliminated.

To solve this problem, it has been suggested to use bicycles to cover the relatively short distance from the commuter's home to the rapid transit station. In addition to being nonpolluting, the cyclist obtains useful exercise during this portion of his commute. Such exercise, in addition to being one of the most effective types of exercise, is also obtained without interfering with the leisure time of the cyclist (that is, it comes during one of his generally non-productive periods).

However, once the cyclist arrives at his destination, it is necessary that he has a place to store his bicycle in a manner preventing theft or the like and protecting it from adverse weather conditions. If a great number of commuters are encouraged to use this form of transportation, storage facilities at such stations would become a problem. Further, once the cyclist-commuter arrived at his destination in the metropolitan area, he may again have a relatively great distance to cover to get to his place of employment. A bicycle at this point would be a considerable advantage; however, the problems of storing and renting such bicycles is again especially acute.

There thus exists a need for providing a means for the storage of bicycles in locations where a great many bicycles may be concentrated. Although the storage of such bicycles has been discussed hereinabove with respect to a rapid transit system, such storage means may be at the commuter's ultimate destination, such as schools, civic buildings, parks, bus stations, shopping centers, office complexes or the like. Finally, such bicycle storage means should provide a locker or the like for completely enclosing an additional bicycle in a manner whereby many such bicycles may be stored in a small space with high security, both for the bicycle and for the lock and fee collecting mechanism, but at low cost.

SUMMARY OF THE INVENTION

It is an object of this invention to provide a means for storing a plurality of individual bicycles or the like each in a separate enclosed space with a high degree of security and protection from the elements.

It is a further object of this invention to provide modular units which can be economically manufactured and quickly installed to provide such bicycle storage means.

It is a still further object of this invention to provide such storage units which require little maintenance and which can be located at a remote location to provide either rentable storage space or rentable bicycles with the fee therefor collected automatically at such remote point with high security.

These and other objects are preferably accomplished by providing a plurality of lockers each storing a single bicycle or the like individually. Each locker provides a volume which is trapezoidal-shaped in cross-section and includes a top wall connected to an end wall and a pair of side walls. The substrate on which the locker is to be mounted may comprise the bottom wall. A door and door locking post are provided for each locker. The door locking post is a tubular member mounted along one side of the open end of the volume of the locker and, with the door which is hinged along the other side of the open end of the volume of the locker, provides means for selectively closing and locking such volumes.

BRIEF DESCRIPTION OF THE DRAWINGS

FIG. 1 is a perspective view of a modular unit including a single locker therein in accordance with our invention erected on a generally horizontal surface;

FIG. 2 is an exploded view in perspective showing the parts of the locker of FIG. 1;

FIG. 3 is a perspective view showing the storing of a bicycle in one of a plurality of lockers of FIG. 1 arranged in a generally circular array;

FIG. 4 is a top plan view of a plurality of the lockers of FIG. 1 arranged in a generally snakelike path;

FIG. 5 is a top plan view of a plurality of lockers according to this invention arranged in a generally linear path;

FIG. 6 is a perspective view of a modification of the modular unit of FIG. 1 having two sections or lockers therein;

FIG. 7 is an exploded view in perspective showing the parts of the unit of FIG. 6;

FIGS. 7A–7E are cross-sectional views of various extrusions which are used in fabricating the unit of FIG. 6;

DESCRIPTION OF THE PREFERRED EMBODIMENT

Figure 9:
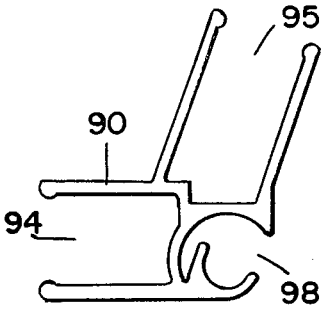
FIG. 9 is a cross-sectional view of one half of a preferred hinge extrusion which may be used in embodiments of this invention.

Referring now to FIG. 1 of the drawings, a modular unit 10 is shown erected on a generally flat horizontal surface or substrate 11. Unit 10 preferably includes a generally trapezoidal-shaped generally planar top wall 12. The wall 12 and surface 11 are generally parallel to each other. Thus, top wall 12 includes a narrow base portion 14 parallel to a wide base portion 15. A first elongated side 16 extends between the ends of base portions 14 and 15 and is generally at an angle of 90° with relation thereto. A second elongated side 17 extends between the other ends of base portions 14 and 15 and forms an angle of more than 90° with respect to the narrow base portion 14 (e.g., about 105°) and an angle of less than 90° with respect to the wide base portion 15 (e.g., about 75°). The bottom edges of the walls 21 and 22 may be rigidly fixed to the surface 11 by means of angle and bracket assemblies 13.

A generally planar rectangular-shaped upstanding end wall 18 is connected to the narrow base portions of the top wall 12 along its short side 19. A pair of planar generally rectangular-shaped upstanding side walls 21 and 22 are connected to the sides 16 and 17 of top wall 12, as shown. Side walls 21 and 22 are also connected to the long sides 23 and 24 of end wall 18. A generally planar rectangular-shaped upstanding closable wall is provided which includes a door 25 connected, e.g., by hinge means 25a or the like, to the unconnected short side of side wall 21. The wall also includes a door locking post 26 connected to side wall 22 for cooperating with door 25 to close the unit 10.

The foregoing has described a completely closable modular unit that can be easily manufactured and quickly set up on any suitable generally horizontal substrate. The various parts of the unit are shown in exploded form in FIG. 2 prior to assembly on the substrate 11 of FIG. 1. Thus, the walls 21 and 22 may be rigidly erected on the surface 11 by means of the angle and bracket assemblies 13 which may include means for leveling the unit if the substrate 11 is uneven, with the walls 12, 18, 25 and post 26 completing the modular unit. Of course, if it is not practicable to utilize surface 11 as the bottom wall of the unit, for example, in a temporary or portable installation, a bottom wall could be mounted between the assemblies 13 to provide a self-contained unit. The walls forming unit 10 have been disclosed hereinabove as being connected in the manner set forth. The term "connected" is used loosely and includes any means for erecting unit 10 on surface 11 to form a completed modular unit. For example, each wall could be provided with suitable angle irons or flanges at one or more corners thereof which interact with the adjacent surfaces of the remaining wall to form a completed assembly. Suitable fastening means, such as rivets, nuts and bolts, screws, etc., may be used to secure the walls together. Further, if planar surface 11 is used as the bottom wall for unit 10, the term "connected" refers to the particular means used to secure unit 10 in fixed position thereon, for example, as by cementing or the like, grooves formed in the surface 11 for receiving the upstanding planar walls, or bolts shot into such surface 11, etc. Various types of materials may be used to form the walls of unit 10. For example, such walls may be of a suitable sheet metal, such as aluminum, wood, light-weight construction materials, etc.

A locking means 27 (see FIG. 2) is provided on door jamb or post 26 associated with appropriate mechanism **27*a* on the door 25 which cooperates with the post 26 in closing off the open end of the unit 10 and in locking unit 10.** Such a lock may be coin-operated, if desired, as is well known in the rental locker art.

In addition to the configuration set forth hereinabove, unit 10 preferably includes certain preferred dimensions related to the size of a conventional bicycle or the like. Generally speaking, most adult-sized bicycles are about 5 feet 10½ inches long and 3 feet 4 inches high. The maximum width of such bicycles is about 2 feet (i.e., the length of the longest conventional handle bars -- the distance between the pedals of such bicycles being less than the distance between the handle grips therefor).

Accordingly, the overall length of unit 10 is about 6 feet (i.e., the distance between the wide and narrow base portions of wall 12). The overall height of unit 10 is about 3 feet 8 inches (i.e., the short sides of the side walls 21 and 22 and the maximum width is about 2-1/6 feet (i.e., the length of the wide base portion 15 of the wall 12).

Since the dimensions of unit 10 vary in width from the front to the rear thereof with the widest portion at the front, the bicycle is stored therein in a reverse manner. That is, as shown in FIG. 3, the bicycle is inserted with the rear wheel toward the rear of the modular unit and the front wheel toward the front thereof (i.e., the handle bars are in the widest portion of the modular unit).

As shown in FIG. 3, a plurality of the modular units of FIG. 1 may be disposed in an arcuate manner, as for example, units 28 through 30 which are identical to unit 10 of FIG. 1. Locks 31 through 33, similar to lock 27, are associated with each unit. Thus, the units 28 through 30 are mounted in a manner whereby their top walls lie in generally the same plane and the front adjacent vertical edges are contiguous. This results in the arcuate array shown in FIG. 3 which may be extended to a full circular array by adding additional units.

Further, as shown in FIG. 4, a first section may be comprised of a plurality of such units is a generally arcuate array, then followed by a second section comprised of a plurality of units in a generally arcuate array but reversed with respect to the first section to form a snakelike or S-type configuration. This is accomplished by placing a modular unit next to a preceding modular unit in a linear manner as will be discussed shortly (i.e., unit 34 is disposed next to preceding unit 35 in a linear, rather than arcuate, manner with the remaining units leading off of unit 34 placed in an arcuate array). Such an array may be desirable for space or aesthetic reasons.

Preferably, as shown in FIG. 5, the individual units of FIG. 1 may be placed in a linear array. The use of a preferred embodiment of this invention to accomplish this type of array will be described hereinbelow with respect to FIGS. 6 and 7. However, as shown in FIG. 5, it can be seen that the entrances to each adjacent locker are staggered, that is, for example, the door of a first locker (door 36 of locker 37) is separated from the door 38 of locker 39 by unit 40, and so on. This linear arrangement is desirable for reasons described hereinbelow.

The means for and advantages of erecting lockers of our invention to form linearly disposed arrays, as shown in FIG. 5, will now be described. Although individual side and top walls may be provided for each locker, as discussed above, from an economy standpoint, in addition to a possible saving in space, the arrangement shown in FIGS. 6 and 7 is preferred. Although different reference numerals will be used to refer to various portions of the lockers of FIGS. 6 and 7, the angular relationships and the configuration of the various walls are identical to those of the unit 10 of FIG. 1 and will not be repeated.

Thus, a first locker or section 42 (which of course is identical in configuration to the modular unit 10 of FIG. 1) is shown having a side wall 44 (which in the arrangement shown in FIG. 5 may be a common wall between two adjacent units) corresponding to wall 22 of FIG. 1. An end wall 41 (corresponding to end wall 18 of FIG. 1) is connected to side wall 44. A door 45 (corresponding to door 25) which includes a hinge means 45*a* cooperates with a door locking post or jamb 46 to close the front of the locker 42.

Second locker or section 48 also includes an end wall 51 and side wall 52 with a door 55 and door jamb 56. When first section 42 is linearly aligned with respect to section 48 in the manner shown in FIG. 6, the door 45 of first section 42 (when closed) lies in substantially the same vertical plane as end wall 51 of second section 48, while the door 55 of second section 48 (when closed) lies in substantially the same vertical plane as end wall 41 of first section 42. In this manner, a rectangular modular unit is formed open at the top thereof.

Thus a common rectangular top wall 52 may be used to enclose the tops of both sections 42 and 48. The interior of the resulting rectangular volume or unit 49 may be divided into the two selectively lockable lockers or sections 42 and 48 by means of a common side wall 53. This side wall 53 corresponds to side wall 21 of unit 10 of FIG. 1.

The dimensions of unit 49 are also related to those of FIG. 1. For example, its overall length is about 6 feet, its overall width in about 32 inches (the combination of the width of the doors 45 and 55 - about 2 feet - the end walls 41 and 51 - about 5¾ inches - the remaining 2¼ inches being taken up by the door jambs 46 and 56 which latter dimensions - end walls 41, 51 and door jambs 46, 56 - may of course vary). The overall height of unit 49 is about 44 inches.

Thus, the interior dimensions of sections 42 and 48 correspond to the interior dimensions of unit 10 of FIG. 1 and a conventional bicycle may be stored in each locker or section 42, 48 in the manner described hereinabove.

Finally, in a permanent installation, any suitable means may be used to securely mount the various upstanding walls on the supporting surface, as for example, by forming suitable channels in the surface - for example, in a cement surface - for receiving the bottom of the upstanding planar surfaces. Suitable adhesives may then be used to securely mount the upstanding walls in these channels. However, the use of assemblies 43 similar to the assemblies 13 of FIGS. 1 and 2 are preferred.

From the above it will be seen that a simple unitary rectangular top wall 52 may be used to cover two adjacent lockers 42, 48 in linear array and that the wall 53 is common to both lockers 42, 48. However, it is of greater importance to note that the wall 44 may serve as a common wall both for the locker 42 and for a subsequent locker 60 (see FIG. 5) in the linear array. Thus, referring to FIG. 7, an end wall 61 of such further locker 60 together with a door 65 of a still further locker 68 are shown mounted at the left hand end of the wall 44. The door jamb or locking post 66 of the further locker 60 is shown mounted at the right hand end of the wall 44.

From the above it will be understood that the basic structural assembly of a linear array of lockers as shown in FIG. 5 comprises an assembly identical to the assembly composed of wall 44, mounting angle and brackets 43, end walls 41 and 61,, door jambs or locking posts 46 and 66 and doors 55 and 65. Thus, the addition of a further such assembly together with a further wall 63 and a further top wall 62 is all that is necessary to add a further pair of lockers to the double unit shown in FIG. 7. It is this simplicity of structure wherein common walls and other structural elements form parts of two adjacent lockers that makes the linear array of lockers shown in FIG. 5 particularly preferable according to the teaching of this invention.

We have found that such linear array of lockers may be assembled in a remote location for maximum security and protection from the elements using only five additional metallic extrusions for interconnecting the various walls and panels of such lockers. Cross-sectional views of each of such extrusions are shown in FIGS. 7A through 7E.

Referring first to FIG. 7A, the door locking post extrusion A is shown in cross-section. We have found that such door locking post extrusion must be tubular and of generally square cross-section in order to provide the necessary security required for our lockers which by their nature are designed to be utilized at a remote location. Thus, the door locking post extrusion provides structural strength in the locker either at a free end of an array of lockers or adjacent the hinged joint between a door and the locker structure. It will be understood that the opening and closing of the doors of the locker, particularly in a large array, will tend to impose stresses on the structure which would not be adequately handled if it were not for the structural strength provided by the tubular door locking post extrusion. The tubular door locking post extrusion also provides advantages related to the security required by the rent collecting aspects of our structure, as will be more fully discussed hereinafter.

As shown in FIG. 7A, the door locking post extrusion A is provided with a flange 70 projecting from a side thereof to provide a jamb or locking member for a door. The door locking post is also provided with an integral channel means 71 on a side thereof adjacent the side from which the flange 70 projects. The channel 71 is adapted to receive one end of a panel such as panels 44 and 48.

The opposite end of panels such as panels 44 and 48 are received in one channel of a double channel extrusion B shown by itself in FIG. 7B and shown rigidly attached to the side of the door locking post A opposite the flange 70 in FIG. 7A. Thus, the extrusion B is adapted to receive one end of a panel such as panels 44 and 48 in the channel 72 thereof and one end of an end wall such as end walls 41, 51 in the second channel 73 which extends at right angles to the first channel 72.

Referring to FIGS. 5 and 6, it will be seen that a door locking post A by itself is used at one end of the panel 48 at the free end of the linear array of lockers and a double channel extrusion B is used by itself at the other end of such panel 48. At all of the intermediate locations of a door locking post in the linear array, the assembly as shown in FIG. 7A and designated assembly AA consisting of a double channel extrusion B rigidly affixed to the side of the door locking post A is used. The use of the assembly AA is required due to the fact that each of the intermediate walls such as wall 44 is common to two adjacent lockers (i.e., lockers 42 and 60).

The double channel extrusion B is also used about all four edges of the top panels such as panels 52, 62. However, it will be understood that the extrusion B on the edge of the top panel 62 adjacent the top panel 52 will not receive a vertical wall since the vertical wall 44 is common to both lockers 42 and 60. However, the adjacent extrusion B on top panels 52, 62 are connected to each other.

Referring to FIG. 7C, a further double channel extrusion C having a first channel 74 for receiving the opposite end of end walls 41, 51 from that received by the channel 73 of the extrusion B is shown. The second channel 75 of the double channel extrusion C extends at an angle of about 105° from the channel 74 and is adapted to receive one end of the panels such as panels 53, 63. Thus, the extrusion C may be simply inverted for use at opposite ends of the panels 53, 63 to support such panels at the proper angle with respect to the end walls 41, 51.

It should be noted at this point that the channels provided by all of the extrusions according to the teaching of this invention are generally U-shaped with a flat bottom and provide generally rectilinear exterior surfaces. It is particularly important that the extrusion C provide a flat exterior surface 76 at the bottom of the channel 74 since such surface 76 provides the mounting surface for the hinge structure shown in FIG. 7B according to this embodiment of the invention.

Referring to FIG. 7D, an assembly comprising a single channel extrusion 77 having one leaf of an elongated piano-type hinge 78 rigidly secured to the flat exterior surface provided at the bottom of the channel extrusion 77 is shown. It will be understood that the other leaf of the piano-type hinge 78 is adapted to be rigidly affixed to the surface 76 of the double channel extrusion C in order to provide an appropriate hinge for the doors 45, 55 which are received in the channel of the channel extrusion 77.

The other three edges of the doors 45, 55 are received in the channels of a further single channel extrusion E. Referring to FIG. 7E, the single channel extrusion E is shown which extrusion includes a flange projecting from one side of the bottom thereof. Such flange has a length sufficient to extend across the joint between the door and the top and side walls of the locker as well as toward the substrate upon which the locker is mounted in order to make it more difficult for anyone to insert a tool in an attempt to pry open the door.

According to the preferred embodiment of this invention, the various channels of the extrusions A through E are adapted to be glued to the panels received therein. To this end a slight inwardly extending flange is formed at the free end of the legs of each of such channels in order to tend to contain the glue inserted in the channel with the panel and provide additional strength for the glued joint. It is, of course, also possible to use screws or other means for fixing the panels within the channels.

From the above it will be seen that a plurality of lockers in linear array may be provided using a small number of identical panels and extrusions. It will also be seen that the panels and extrusions provide the structural strength and security required to enable the lockers to be placed at a remote point for use without undue danger due to tampering or attempted break-ins. Finally, it will be seen that the panels and extrusions are joined together in such a way as to provide protection of the bicycles in the lockers from the elements such as rain, wind, snow and ice.

Figure 8:
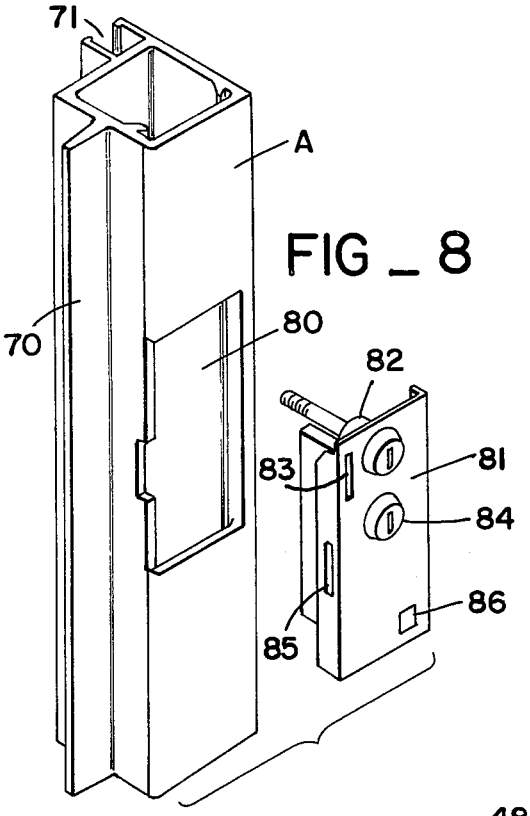
FIG. 8 is a perspective view of an embodiment of the door locking post and locking mechanism which is used according to the teaching of this invention with the post foreshortened for ease of illustration.

Referring to FIG. 8, a preferred door locking means is shown in partially exploded view. Such preferred door locking means includes the tubular door locking post extrusion A (shown in FIG. 8 in foreshortened form) having an appropriate opening 80 cut in the side thereof adjacent the side carrying the flange 70 and opposite the side carrying the channel 71. Such opening 80 is adapted to receive a coin-operated key type locking mechanism 81 of the type which is commercially available for use on various coin-operated lockers. It will be understood that the locking mechanism 81 includes a key-operated mounting means 82 to enable the owner to remove the lock in order to recover coins inserted by patrons in the coin slot 83 to actuate the coin-operated key type locking mechanism 84. The locking mechanism 84, of course, actuates a bolt 85 to cause it to engage an appropriate slot in the door associated therewith. The locking mechanism may also include an appropriate counter 86 so that the owner can demonstrate how many times the locker has been used in a particular period of time.

It will be understood that the tubular formation of the door locking post extrusion A provides a safe receptacle for the coins placed in the lock mechanism 81 by the patrons. Thus, the door locking post extrusion A not only provides the necessary structural strength for the locker but also provides a locker within the locker for receipt of the coins with reduced danger of tampering or robbery.

Figure 10:
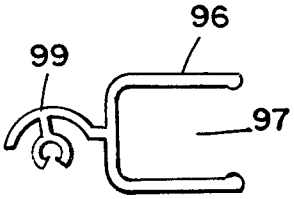
FIG. 10 is a cross-sectional view of the other half of the hinge extrusion of FIG. 9.
Figure 11:
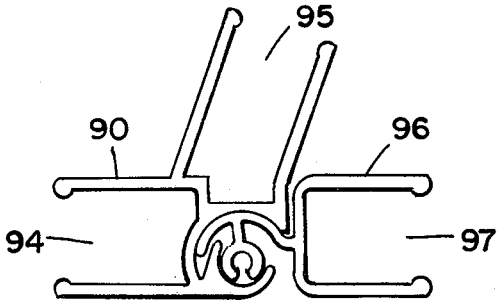
FIG. 11 is a cross-sectional view of the two halves of the hinge extrusion of FIGS. 9 and 10 in hinging engagement with each other.

Referring to FIGS. 9 through 11, an improved hinge structure for use in lockers according to this invention is shown including two extrusions for use in place of extrusion C and the assembly D consisting of extrusion 77 and hinge 78. Thus, in FIG. 9, a double channel extrusion 90 is shown which includes channels 94 and 95 corresponding to channels 74 and 75 of the extrusion C. Similarly, referring to FIG. 10, an extrusion 96 is shown providing a channel 97 corresponding to the channel provided by the extrusion 77 of the assembly D. The extrusion 90 is provided with a hinge socket 98 and the extrusion 96 is provided with a hinge projection 99 as shown in FIGS. 9 and 10. In use, the hinge projection 99, which extends the full length of the extrusion 96, is inserted axially in the hinge socket 98 which extends the full length of the extrusion 90. Thus, once the extrusions 90 and 96 have been assembled as shown in FIG. 11 and incorporated into a locker structure, they cannot be disconnected because axial movement along the socket 98 between the extrusions 90 and 96 is no longer possible. However, the extrusions 90 and 96 will pivot with respect to each other in the manner of a hinge. It will be understood that the hinge structure shown in FIGS. 9 through 10 will tend to be more tamper-proof than the piano type hinge discussed hereinabove which includes a pin interconnecting the two leaves thereof which pin may be cut or otherwise removed to enable access to the interior of the locker. The hinge structure shown in FIGS. 9 through 11 will also tend to be more impervious to wind and water, thus providing greater protection from the elements.

Figure 13:
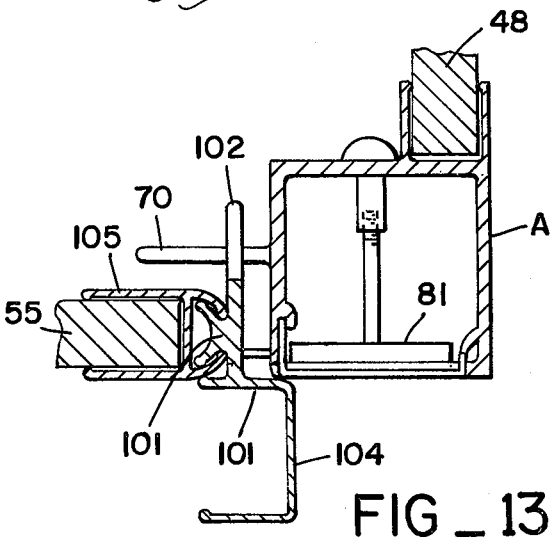
FIG. 13 is a cross-sectional view of the door locking post and complete locking mechanism of FIG. 12 showing fragmentary portions of the door and a wall.
Figure 12:
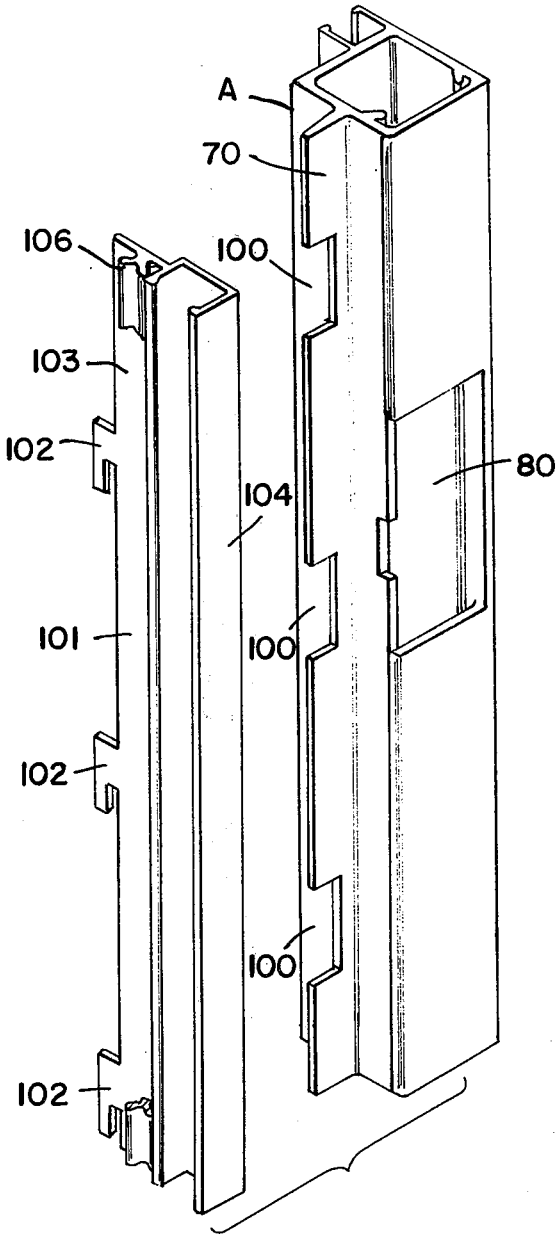
FIG. 12 is a perspective view of another embodiment of the door locking post and a portion of another locking mechanism according to the teaching of this invention with the members foreshortened for ease of illustration.

Referring to FIGS. 12 and 13, a further improvement in the locking means for a locker according to this invention is shown. As shown in FIG. 12, the door locking post extrusion A is provided with an opening 80 for receipt of a locking mechanism such as that described in connection with FIG. 8. However, the flange 70 of the door locking post extrusion A is provided with a plurality of notches 100, spaced from each other along the length of such flange 70. A door bar extrusion 101 is shown in FIG. 12 in exploded relation to the door locking post extrusion A. The door bar extrusion includes a plurality of dogs 102 spaced along the length of a flange 103 which extends from one side of an elongated U-shaped handle 104. The dogs 102 are adapted to cooperate with the notches 100 in the flange 70 of the door locking post extrusion A so that when the handle 104 is properly positioned the dogs 102 will be received through the notches 100 and when the handle is then moved downwardly, the dogs will straddle the flange 70 at the bottom of the notches 100.

As shown in FIG. 13, the door extrusion 101 is mounted at the free end of a door such as door 55. The mounting of the door bar extrusion 101 is accomplished through the use of a further extrusion 105 providing a channel for receiving the door 55 and a further channel for receiving a slide member 106 provided on the door bar extrusion 101. As shown in FIG. 13, the slide member 106 of the extrusion 101 is adapted to slide upwardly and downwardly in the channel provided by the extrusion 105 at the free end of the door 55 to thereby enable the dogs 102 to be selectively engaged and disengaged with the notches 100 in the flange member 70 of the extrusion A.

The door bar extrusion 102 is also provided with a slot to receive the bolt of the lock mechanism 81 when the dogs 102 are in locking engagement with the notches 100. Thus it will be seen that a three-point locking action is provided between the door and the door locking post. This, coupled with the fact that the handle 104 of the door bar extrusion projects across the joint between the free end of the door and the door locking post, makes it extremely difficult for anyone to tamper with the locking mechanism or attempt to pry open the door.

As best shown in FIG. 13, the coin-operated locking mechanism 81 is received within the tubular door locking post extrusion A and is thus protected from tampering not only from outside the locker but also from inside the locker. Thus, in addition to providing structural integrity in the locker itself, the tubular door locking post also provides a safe receptacle for the coin-operated door locking mechanism 81 and the coins collected thereby.

From the above it will be seen that the lockers according to this invention can be easily and economically manufactured and then easily erected at a desired remote location with great structural integrity. Such lockers being completely enclosed, render the bicycles therein free from theft, vandalism, the elements, etc. In addition, the structure of the lockers enables the use of coin-operated locks with reduced danger that they will be tampered with or robbed due to the structural integrity of the tubular door locking posts which also provide the strength required when a large number of the units are mounted in an array in order to render the array insensitive to the stresses which might be imposed thereon by the opening of a large number of doors of the array simultaneously or an attempt to destroy the integrity of the array by the exertion of forces of an opened door.

The particular configuration of the lockers conserves the space required for storing bicycles. Further their configuration is such that the bicycles are maintained in a generally upright position, thereby preventing damage to the bicycles during storage and ease in placing the bicycles in storage.

It will be understood that the extrusion shown in FIGS. 7A through 7E, as well as the extrusions of FIGS. 9 through 13, could be used as appropriate in constructing single lockers as described in connection with FIGS. 1 through 4. In any event, as shown in FIG. 2, a tubular door locking post must be used even in fabricating a single locker unit in order to provide the structural strength and the locking security which are the basic advantages of a bicycle locker according to the teaching of this invention. It will be understood that if such structural strength and security are lacking, cyclist will not be encouraged to use their bicycles to any greater extent than the encouragement offered by the more conventional bicycle locking devices currently available on the market. Thus, although certain modifications will undoubtedly be made by those skilled in the art in adapting lockers according to the teaching of this invention for specific uses, we have found that the lockers must include the basic structural elements as set forth in the following claims in order to provide the advantages necessary to encourage the use of bicycles and enable storage space and bicycles to be rented at remote locations through the use of automatic coin-operated locking means.

We have found aluminum to be the preferred metal for use in fabricating the extrusion shown in FIGS. 7–12, since aluminum extrusions will provide the required structural strength and resistance to weathering and vandalism with minimum maintenance requirements for continued attractive appearance at an acceptable cost in view of the economic considerations involved.

What is claimed is:

1. A sub-combination of a modular unit for storing a plurality of bicycles or the like in a linear array on a substrate whereby each bicycle is stored in an individual selectively closable locker, said sub-combination comprising:

a. a first plurality of identical upstanding horizontally elongated rectangular-shaped planar walls having vertical ends and horizontal sides, said walls being equally spaced from each other by a given distance in parallel array with their horizontal sides extending normally to a given line passing through the centers thereof.

b. a plurality of pairs of identical vertically extending tubular posts, each pair of said posts being associated with a different one of said first plurality of walls and each post of each pair being rigidly connected to the one of said first plurality of walls associated therewith along a different one of said vertical ends thereof;

c. a plurality of pairs of identical vertically elongated generally rectangular-shaped planar end walls having vertical sides and horizontal ends, each pair of said end walls being associated with a different one of said first plurality of walls and each end wall of each pair having one of its vertical sides rigidly connected to a different one of said pair of posts with said horizontal ends of said pair of end walls extending normally to said horizontal sides of said one of said first plurality of walls associated therewith in opposite directions therefrom;

d. a plurality of pairs of identical vertically elongated generally rectangular-shaped planar doors having vertical sides and horizontal ends, each pair of said doors being associated with a different one of said first plurality of walls and each door of each pair being hinged along one of its vertical sides to the free vertical side of a different one of said end walls, each of said doors and the one of said end walls associated therewith having a total horizontal extent substantially equal to said given distance by which said first plurality of walls are spaced from each other and the horizontal ends of said end walls having a length less than one-half of the length of the horizontal ends of said doors;

e. a second plurality of identical upstanding horizontally elongated rectangular-shaped planar walls having vertical ends and horizontal sides, each of said second plurality of walls being positioned between a different pair of said first plurality of walls with one of its vertical ends rigidly connected to the hinged joint between an end wall and door associated with one of said pair of said first plurality of walls and its other end rigidly connected to the hinged joint between an end wall and door associated with the other of said pair of said first plurality of walls;

f. a plurality of identical elongated rectangular-shaped planar top walls each having horizontal sides equal in length to the horizontal sides of said first plurality of walls and horizontal ends substantially equal in length to said given distance by which said first plurality of walls are spaced from each other, each of said plurality of top walls being associated with a different pair of said first plurality of walls with each horizontal side of each top wall rigidly connected to a different one of said pair of said first plurality of walls associated therewith; and g. means for rigidly connecting each of said first plurality of walls to said substrate.

2. A modular unit including the sub-combination as claimed in claim 1 and further including:

a first pair of upstanding horizontally elongated rectangular-shaped planar walls having vertical ends and horizonal sides and being identical to said walls of said first plurality of walls, each of said first pair of walls having a vertically extending tubular post rigidly connected thereto along one vertical end thereof, and each of said first pair of walls having one vertical side of a vertically elongated generally rectangular-shaped planar end wall having vertical sides and horizontal ends identical to said end walls of said plurality thereof rigidly connected to the other vertical end thereof with said horizontal ends of said end wall extending normally to said horizontal side of said wall and with a vertically elongated generally rectangular-shaped planar door having vertical sides and horizontal ends identical to said doors of said plurality of doors hinged along one of its vertical sides to the free vertical side of said end wall;

each of said first pair of walls being positioned in said parallel array with said first plurality of walls at a different end thereof and spaced from the one of said plurality of walls adjacent thereto in said array by said given distance with the end wall connected thereto extending toward said array;

a further pair of identical upstanding horizontally elongated rectangular-shaped planar walls having vertical ends and horizontal sides identical to said second plurality of walls, each of said second pair of walls being positioned between a different one of said first pair of walls and the one of said plurality of walls adjacent thereto in said array with one of its vertical ends rigidly connected to the hinged joint between the end wall and door associated with said one of said first pair of walls associated therewith and the other of its vertical ends rigidly connected to the hinged joint between the end wall and door of said adjacent one of said plurality of walls in said parallel array;

and a further pair of top walls having horizontal side and end walls identical to said plurality of top walls each of said further pair of top walls being associated with a different one of said first pair of walls with one horizontal side thereof rigidly connected to the one of said first pair of walls associated therewith and the other horizontal side thereof rigidly connected to the adjacent one of said first plurality of walls in said array.

3. A modular unit as claimed in claim 2 wherein a locking means is included in each post of said plurality of pairs of tubular posts for engagement with the free side of the door of said plurality of pairs of doors associated therewith.

4. A modular unit as claimed in claim 2 wherein said means for connecting each of said first plurality of walls to said substrate comprises an angle and bracket means.

5. A modular unit as claimed in claim 2 wherein each post of said plurality of pairs of posts is a tubular extrusion including an externally open channel extending vertically along said post for receiving a vertical end of one of said first plurality of walls to provide said rigid connection therebetween.

6. A modular unit as claimed in claim 2 wherein each post of said plurality of pairs of posts has an externally open channel member rigidly mounted thereon and extending vertically along said post to receive a vertical side of one of said plurality of pairs of end walls.

7. A modular unit as claimed in claim 2 wherein said hinged joint between associated ones of said plurality of pairs of doors and said plurality of pairs of end walls comprises an elongated single channel extrusion hinged to a further elongated extrusion, said further extension being a double channel extrusion having a first channel opening normally of said hinged joint and a second channel opening at an obtuse angle with respect to the opening of said first channel, said single channel receiving the vertical side of said associated door, said first channel of said double channel extrusion receiving the vertical side of said associated end wall and said second channel of said double channel extrusion receiving the vertical end of one of said second plurality of walls.

8. A modular unit as claimed in claim 2 wherein said other vertical edge of each of said first pair of walls is rigidly connected to said vertical side of said end wall by means of an elongated double channel extrusion having channels opening at right angles to each other.

9. A modular unit as claimed in claim 2 wherein each horizontal side of each of said plurality of top walls is rigidly connected to the horizontal side of the one of said pair of said first plurality of walls associated therewith by means of an elongated double channel extrusion having channels opening at right angles to each other.

10. A modular unit as claimed in claim 3 wherein said locking means included in each post of said plurality of pairs of tubular posts comprises a coin-operated lock mechanism having a bolt which is selectively engagable with the free end of the door associated therewith upon insertion of a coin.

11. A modular unit as claimed in claim 10 wherein the free side of said door is provided with an elongated slide member mounted for vertical sliding movement with respect to said door and having a plurality of dogs selectively engagable with a plurality of dog receiving notches provided on said post and said bolt engages means provided on said slide member for fixing said slide member with the dogs thereof in locking engagement with the notches of said post.

12. A modular unit for storing a plurality of bicycles or the like in a linear array on a substrate whereby each bicycle is stored in an individual selectively closeable locker, said unit comprising:

a. a pair of identical upstanding horizontally elongated rectangular-shaped planar sidewalls having vertical ends and horizontal sides;

b. a first pair of identical vertically extending tubular posts, each post of said first pair of posts being rigidly connected to a different one of said pair of said sidewalls along one vertical end thereof;

c. a first pair of identical vertically elongated generally rectangular-shaped planar end walls having vertical sides and horizontal ends, each end wall of said first pair of end walls being associated with a different one of said pair of sidewalls and each end wall of said pair of end walls having one of its vertical sides rigidly connected to a different one of said pair of posts with said horizontal ends of said pair of end walls extending normally to said horizontal sides of said one of said pair of side walls associated therewith;

d. a first pair of identical vertically elongated generally rectangular-shaped planar doors having vertical sides and horizontal ends, each door of said first pair of doors being associated with a different one of said first pair of end walls and each door of said first pair of doors being hinged along one of its vertical sides to the free vertical side of said one of said first pair of end walls associated therewith;

e. a pair of identical upstanding horizontally elongated rectangular-shaped planar divider walls having vertical ends and horizontal sides, each divider wall of said pair of divider walls being associated with a different one of said pair of side walls with one of its vertical ends rigidly connected to the hinged joint between the one of said first pair of end walls and the one of said first pair of doors associated with the one of said pair of sidewalls with which said divider wall is associated;

f. an upstanding horizontally elongated rectangular-shaped planar common wall having vertical ends and horizontal sides identical to each of said pair of identical side walls;

g. a second pair of identical vertically extending tubular posts, each post of said second pair of posts being rigidly connected to a different one of said vertical ends of said common wall;

h. a second pair of said identical vertically elongated generally rectangular-shaped planar end walls having vertical sides and horizontal ends, each end wall of said second pair of end walls having one of its vertical sides rigidly connected to a different one of said second pair of posts with said horizontal ends of said pair of end walls extending normally to said horizontal sides of said common wall in opposite directions therefrom;

i. a second pair of said identical vertically elongated generally rectangular-shaped planar doors having vertical sides and horizontal ends, each door of said second pair of doors being hinged along one of its vertical sides to the free vertical side of a different one of said second pair of end walls and the horizontal ends of said first and second pairs of end walls having a length less than one-half of the length of the horizontal ends of said doors;

j. said pair of side walls and said common wall being equally spaced from each other by a given distance equal to the total of the length of the horizontal end of one of said identical end walls and the length of the horizontal end of one of said identical doors, said pair of sidewalls and said common wall being arranged in parallel array with said common wall interposed between said pair of side walls and with the horizontal sides of said common wall and side walls extending normally to a given line passing through the center thereof and with the free end of each of said pair of dividing walls rigidly connected to the hinged joint between a different one of said second pair of end walls and a different one of said second pair of doors;

k. a pair of identical elongated rectangular-shaped planar top walls each having horizontal sides equal in length to the horizontal sides of said first pair of side walls and horizontal ends substantially equal in length to said given distance by which each of said first pair of side walls is spaced from said common wall, each of said pair of top walls being associated with a different one of said pair of side walls with one horizontal side of each of said pair of top walls rigidly connected to said common wall and the other horizontal side of each of said pair of top walls rigidly connected to the one of said pair of side walls associated therewith; and l. means for rigidly connecting each of said pair of side walls to said substrate.

* * * * *

UNITED STATES PATENT AND TRADEMARK OFFICE

CERTIFICATE OF CORRECTION

PATENT NO. : 3,967,425

DATED : July 6, 1976

INVENTOR(S) : RICHARD A. WOLVERTON and GORDON H. COOPER

It is certified that error appears in the above-identified patent and that said Letters Patent are hereby corrected as shown below:

Column 1, line 51, "has" should be --have--.
Column 2, line 38, "volumes" should be --volume--.
Column 4, line 30, "therefor" should be --thereof--.
Column 4, line 57, "is" should be --in--.
Column 5, line 53, "in" should be --is--.
Column 6, line 1, "bottom" should be --bottoms--.
Column 6, line 38, "additional" should be --different--.
Column 7, line 53, "secured" should be --mounted--.
Column 8, line 44, "demonstrate" should be --determine--.
Column 9, line 38, after "door" insert --bar--.
Column 10,line 18, after "forces", "of" should be --on--.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*